US008217847B2

(12) United States Patent
Sotelo et al.

(10) Patent No.: US 8,217,847 B2
(45) Date of Patent: Jul. 10, 2012

(54) LOW LOSS, VARIABLE PHASE REFLECT ARRAY

(75) Inventors: Michael John Sotelo, Chino, CA (US); Kenneth William Brown, Yucaipa, CA (US)

(73) Assignee: Raytheon Company, Waltham, MA (US)

( * ) Notice: Subject to any disclaimer, the term of this patent is extended or adjusted under 35 U.S.C. 154(b) by 608 days.

(21) Appl. No.: 11/861,621

(22) Filed: Sep. 26, 2007

(65) Prior Publication Data

US 2009/0079645 A1 Mar. 26, 2009

(51) Int. Cl.
*H01Q 19/10* (2006.01)

(52) U.S. Cl. ..... 343/755; 343/912; 343/700 MS

(58) Field of Classification Search ..... 343/755, 343/756, 909, 912, 700 MS
See application file for complete search history.

(56) References Cited

U.S. PATENT DOCUMENTS

| | | | | |
|---|---|---|---|---|
| 4,684,952 | A | 8/1987 | Munson et al. | |
| 4,905,014 | A | 2/1990 | Gonzalez | |
| 5,434,580 | A * | 7/1995 | Raguenet et al. | 343/700 MS |
| 5,864,322 | A * | 1/1999 | Pollon et al. | 343/909 |
| 6,020,853 | A | 2/2000 | Richards | |
| 6,091,365 | A | 7/2000 | Derneryd | |
| 6,396,449 | B1 | 5/2002 | Osterhues | |
| 6,744,411 | B1 | 6/2004 | Osterhues | |
| 6,795,020 | B2 | 9/2004 | Sreenivas | |
| 6,885,355 | B2 | 4/2005 | Killen | |
| 7,142,164 | B2 | 11/2006 | Legay et al. | |
| 7,259,721 | B2 * | 8/2007 | Chang et al. | 343/700 MS |
| 2003/0122729 | A1 | 7/2003 | Diaz et al. | |
| 2004/0100343 | A1 | 5/2004 | Tsu | |
| 2005/0122266 | A1 * | 6/2005 | Chang et al. | 343/700 MS |

FOREIGN PATENT DOCUMENTS

EP 1 120 856 8/2001

OTHER PUBLICATIONS

Feng-Chi Tsai et al., Designing a 161-Element Ku-Band Microstrip Reflectarray of Variable Size Patches Using an Equivalent Unit Cell Waveguide Approach, IEEE Transactions on Antennas and Propagation, vol. 51, No. 10, Oct. 2003, pp. 2953-2962.*

John Huang, Reflectarray Antennas, Mar. 14, 2007, IEEE, pp. 1-6, 27 and 119-133.*

Malibu Research, FLAPS Antenna Technology, 2007.

Pozar et al., A Shaped-Beam Microstrip Patch Reflectarray, IEEE Transactions on Antennas and Propagation, vol. 47, No. 7, Jul. 1999, pp. 1167-1173.

Kelkar, Flaps: Conformal Phased Reflecting Surfaces, Malibu Research Associates, Calabbasas California, pp. 58-62.

Huang et al., A Ka-Band Microstrip Reflectarray with Elements Having Variable Rotation Angles, IEEE Transactions on Antennas and Propagation, vol. 46, No. 5, May 1998, pp. 650-656.

Chang et al., Multiple-Polarization Microstrip Reflectarray Antenna with High Efficiency and Low Cross-Polarization, IEEE Transactions on Antennas and Propagation, vol. 43, No. 8, Aug. 1995, pp. 829-834.

(Continued)

*Primary Examiner* — Dieu H Duong

(57) ABSTRACT

There is disclosed reflect array including a dielectric substrate having a first surface and a second surface. The first surface may support a first array of phasing elements and a second array of phasing element, where the elements of the first array have a first shape and the elements of the second array may have a second shape different from the first shape. The second surface may support a conductive layer.

20 Claims, 10 Drawing Sheets

OTHER PUBLICATIONS

Javor et al., Design and Performance of a Microstrip Reflectarray Antenna, IEEE Transactions on Antennas and Propagation, vol. 43, No. 9, Sep. 1995, pp. 932-939.
Bialkowski et al., Dual Linearly Polarized Reflectarray Using Aperture Cuopled Microstrip Patches, School of Computer Science and Electrical Engineering, University of Queensland, IEEE 2001, pp. 486-489.
Robinson et al., An X-Band Passive Reflect-Array Using Dual-Feed Aperture-Coupled Patch Antennas, IEEE 1999, pp. 906-909.
Bialkowski et al., Design, Development, and Testing of X-Band Amplifying Reflectarrays, IEEE Transactions of Antennas and Propagation, vol. 50, No. 8, Aug. 2002, pp. 1065-1076.
Kelkar, FLAPS: Conformal phased reflecting surfaces, Mar. 1991, pp. 1-6.

* cited by examiner

Note: contour lines represent reflection loss in dB, with increments of 0.05 dB

Note: contour lines represent phase shift in degrees, as labeled.

LOW LOSS, VARIABLE PHASE REFLECT ARRAY

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to reflectors for microwave and millimeter wave radiation.

2. Description of the Related Art

Passive reflect arrays are arrays of conductive elements adapted to reflect microwave or millimeter wave radiation within a predefined wavelength band. The radiation may be reflected with a phase shift that is dependent on the size, shape, or other characteristic of the conductive elements. The size, shape, or other characteristic of the conductive elements may be varied to cause a varying phase shift across the extent of the array. The varying phase shift may be used to shape or steer the reflected radiation. Reflect arrays are typically used to provide a reflector of a defined physical curvature that emulates a reflector having a different curvature. For example, a planar reflect array may be used to collimate a diverging microwave or millimeter wave beam, thus emulating a parabolic reflector.

DETAILED DESCRIPTION

Within this description, the term "shape" is used specifically to describe the form of two-dimensional elements, and the term "curvature" is used to describe the form of three-dimensional surfaces. Note that the term "curvature" may be appropriately applied to flat or planar surfaces, since a planar surface is mathematically equivalent to a curved surface with an infinite radius of curvature. The term "microwave" is used to describe the portions of the radio frequency spectrum above approximately 1 GHz, and thus encompasses the portions of the spectrum commonly called microwave, millimeter wave, and terahertz radiation. The term "phase shift" is used to describe the change in phase that occurs when a microwave beam is reflected from a surface or device. A phase shift is the difference in phase between the reflected and incident beams. Within this description, phase shift will be measured in degrees and defined, by convention, to have a range from −180 degrees to +180 degrees.

Description of Apparatus

Figure 1:
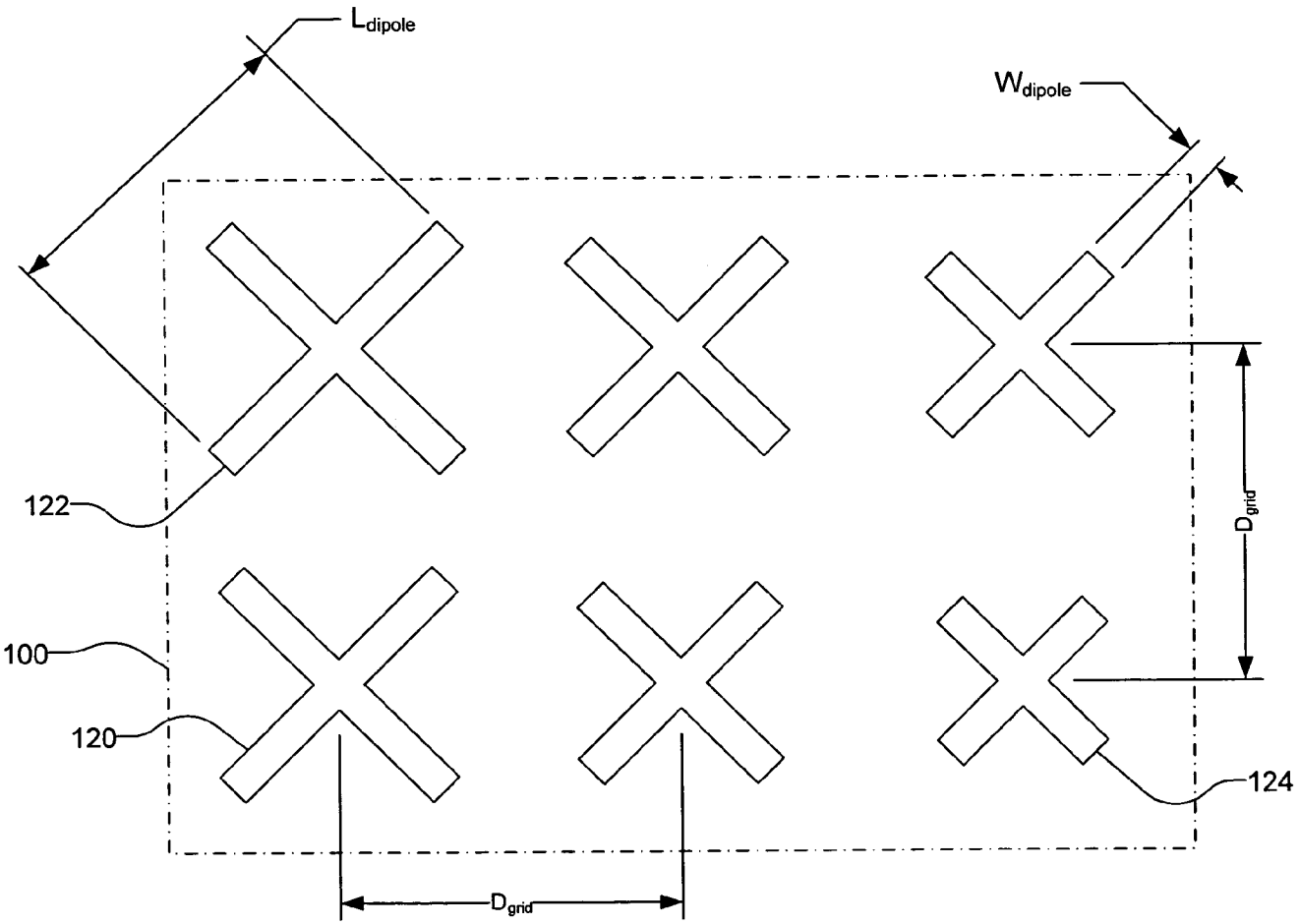
FIG. 1 Prior Art
FIG. 1 is a plan view of a variable phase reflect array.

Referring now to FIG. 1, a exemplary reflect array 100 of a known configuration may include a two-dimensional array or grid of conductive elements, such as conductive element 120. The dimensions and shape of each conductive element may determine the electrical phase shift induced when microwave radiation is reflected from the reflect array. Thus the conductive elements will be referred to herein as "phasing elements". The phasing elements may be disposed on a rectangular grid and the distance between adjacent rows and columns of phasing elements may be $D_{grid}$. In this description, the terms "rows" and "columns" refer to the elements of the reflect array as shown in the figures and do not imply any absolute orientation of the reflect array. The reflect array 100 may be adapted to reflect microwave radiation within a predetermined wavelength band. The distance $D_{grid}$ may be less than one wavelength, and may be about 0.5 wavelengths, of the microwave radiation in the predetermined frequency band.

As illustrated in the exemplary reflect array 100, each phasing element may have an "X" shape, but the phasing elements may have other shapes. X-shaped phasing elements may operate as crossed dipole structures, and may be characterized by dimensions $L_{dipole}$ and $W_{dipole}$. At least one dimension of the phasing elements may be varied across the reflect array. In the exemplary reflect array 100, the dimension $L_{dipole}$ is varied between the rows and columns of the reflect array such that phasing element 122 has the largest value of $L_{dipole}$ and phasing element 124 has the smallest value of $L_{dipole}$. As will be described subsequently, a variation in the size of the phasing elements may be used to control the phase shift of microwave energy reflected from the reflect array and thus vary the wavefront of the reflected microwave energy.

The width of the dipole elements ($W_{dipole}$) may not be critical to the performance of the reflect array. The width of the dipole elements may be from 0.01 to 0.1 times the wavelength of operation of the reflect array, or some other dimension.

Figure 2:
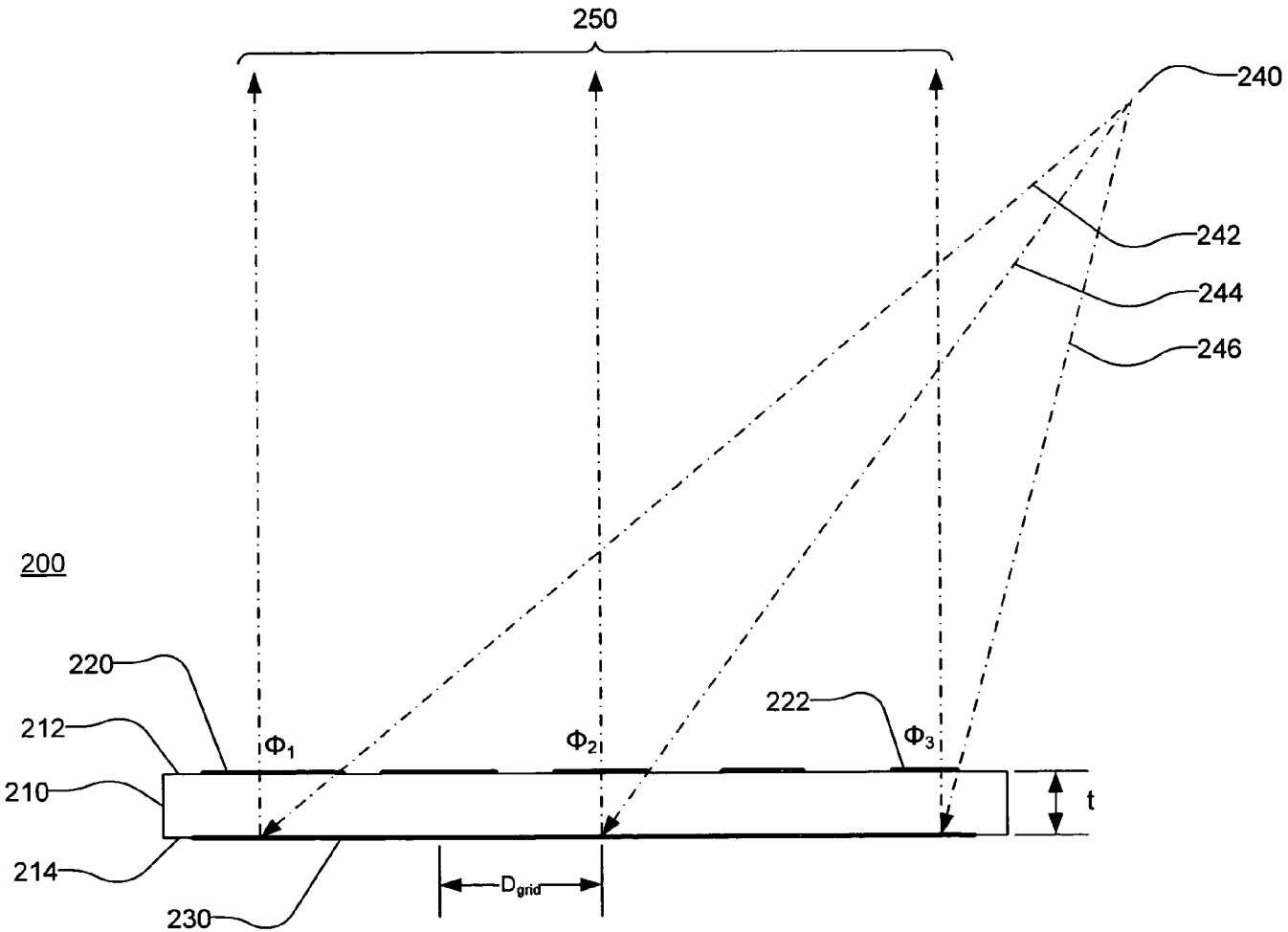
FIG. 2 is a side view of a variable phase reflect array.

Referring now to FIG. 2, an exemplary reflect array 200, which may be the reflect array 100 or another reflect array, may include a dielectric substrate 210 having a first surface 212 and a second surface 214. The dielectric substrate may be a ceramic material, a composite material such as DUROID® (available from Rogers Corporation), or some other dielectric material suitable for use at the frequency of interest. The dielectric substrate 210 may have a thickness t. The thickness t may be substantially less than one wavelength of the microwave radiation in the predetermined frequency band to prevent higher-order diffraction modes from being reflected by the reflect array. The thickness may be about 0.1 times the wavelength of operation of the reflect array.

The second surface 214 may support a conductive layer 230. The conductive layer 230 may be continuous over the second surface 214 and may function as a ground plane. The conductive layer 230 may be a thin metallic film deposited onto the second surface 214, or may be a metallic foil laminated to the second surface 214. The conductive layer 230 may be a metal element, such as a metal plate that may also function as a heat sink, bonded or otherwise affixed to the second surface 214.

The first surface 212 may support an array of conductive phasing elements such as element 220. The phasing elements may be formed by patterning a thin metallic film deposited onto the first surface 210, or by patterning a thin metallic foil laminated onto the first surface 210, or by some other method.

At least one dimension of the phasing elements may be varied across the reflect array 200. In the example of FIG. 2, the length of the phasing elements is varied such that phasing element 220 is longer than phasing element 222. The variation in the dimension of the phasing elements may result in a variation of the phase shift of microwave radiation reflected from the reflect array 200. For example, incident microwave radiation 242 may be reflected with a phase shift of $\phi_1$, incident microwave radiation 244 may be reflected with a phase shift of $\phi_2$, and incident microwave radiation 246 may be reflected with a phase shift of $\phi_3$. The variation in phase shift across the reflect array 200 may redirect and/or change the wavefront of the reflected microwave radiation. In the example of FIG. 2, incident microwave radiation 242, 244, 246 may be portions of a spherical wave emanating from a point source 240. The reflected wavefront 250 may be a plane, or collimated wavefront. Thus, in the example of FIG. 2, the planar reflect array 200 may emulate the optical characteristics of an off-axis parabolic reflector.

It should be understood that the exemplary reflect array 200 is a bidirectional device also capable of focusing a collimated input beam to a point.

By properly varying the phase shift across the extent of a reflect array, a reflect array having a first curvature may be adapted to emulate the optical characteristics of a reflector having a second curvature different from the first curvature. A planar reflect array may be adapted to emulate a parabolic reflector, a spherical reflector, a cylindrical reflector, a torroidal reflector, a conic reflector, a generalized aspheric reflector, or some other curved reflector. A reflect array having a simple curvature, such as a cylindrical or spherical curvature, may be adapted to emulate a reflector having a complex curvature such as a parabolic reflector, a torroidal reflector, a conic reflector, or a generalized aspheric reflector.

Figure 3:
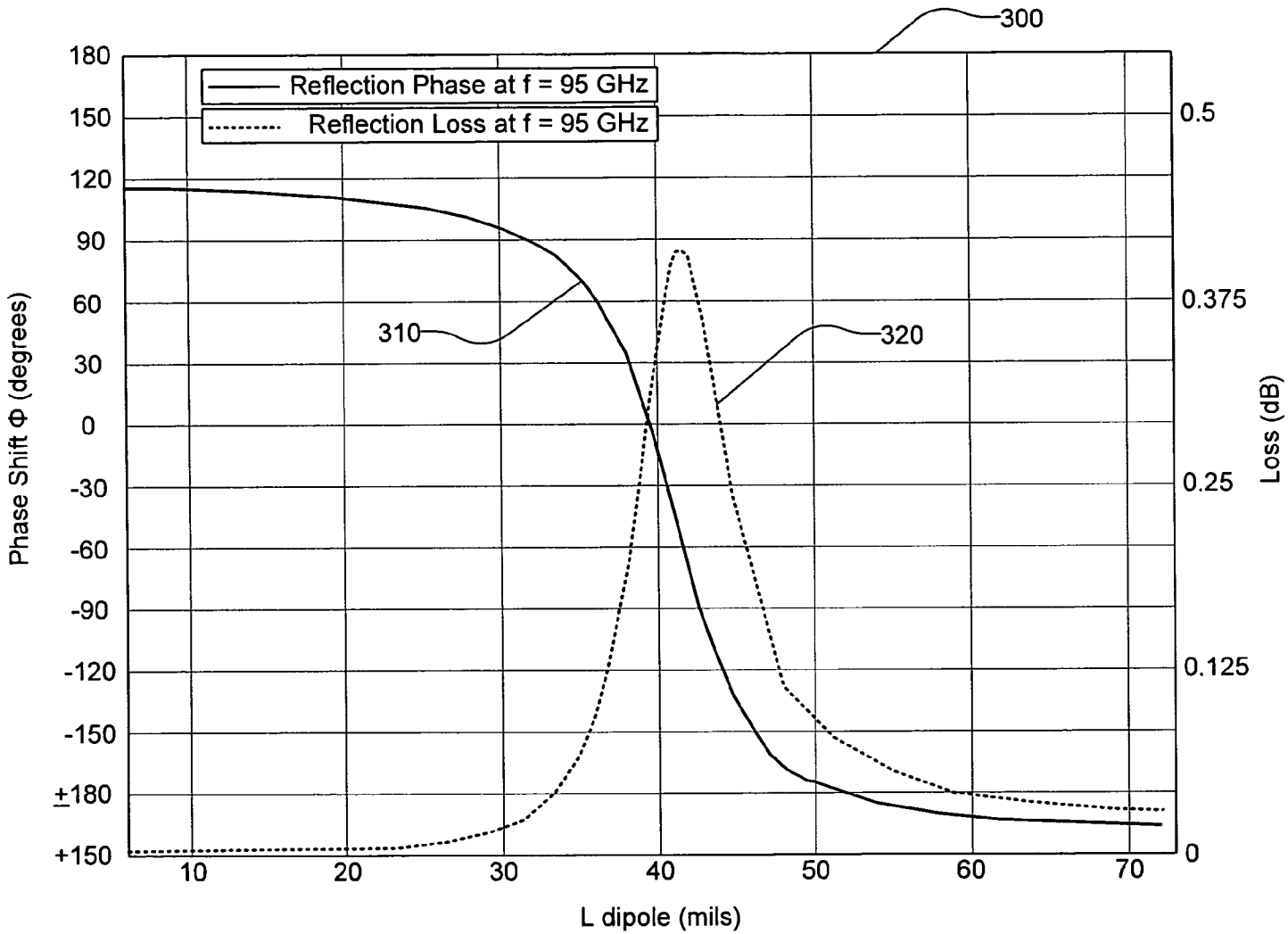
FIG. 3 is a graphical representation of the performance of a variable phase reflect array.

FIG. 3 shows a graph 300 of data, obtained by simulation, showing the performance of a cross-dipole reflect array, such as reflect array 100, as a function of the dipole length dimension $L_{dipole}$. The data summarized in the graph 300 was simulated for a frequency of 96 GHz using specific assumptions for the substrate material, substrate thickness, grid spacing $D_{grid}$, and dipole width $W_{dipole}$.

As shown by the curve 310, the phase shift may be varied from about +115 degrees to +160 degrees (after wrapping through ±180 degrees) by varying the dipole length from less than 10 mils (0.010 inches) to more than 70 mils (0.070 inches). However, for the assumed combination of substrate material, substrate thickness, grid spacing $D_{grid}$, and dipole width $W_{dipole}$, it may not be possible to achieve a phase shift between 115 degrees and 160 degrees. The inability to achieve a continuously variable phase shift over a 360-degree range may limit the capability of a reflect array, such as reflect array 100, to accurately direct and form a reflected beam.

As shown by the curve 320, the simulated reflection loss also varies with the dipole length. The reflection loss for a crossed-dipole reflect array may reach a maximum of approximately 0.4 db when the dipole length is equal to one-half of the wavelength of the reflected radiation (including the effect of the dielectric constant of the substrate). The reflection loss peak may occur when the length of the dipole is such that the dipole resonates at the wavelength being reflected from the reflect array.

Figure 4:
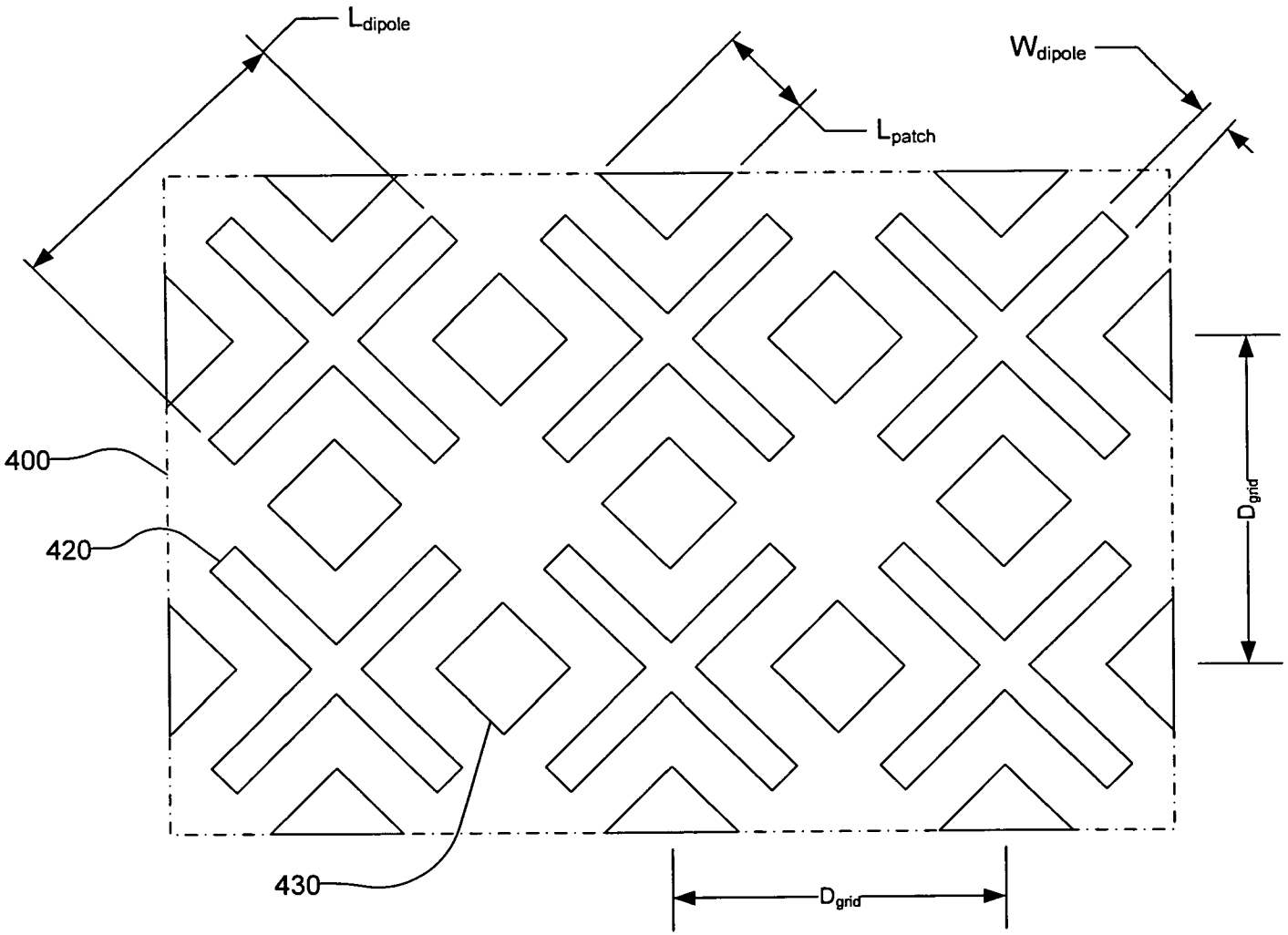
FIG. 4 is a plan view of a low loss variable phase reflect array.

Referring now to FIG. 4, an exemplary reflect array 400 may include a first two-dimensional array 420 of phasing elements and a second two-dimensional array of phasing elements 430. The first array 420 of phasing elements may be disposed on a rectangular grid and the distance between adjacent rows and columns of phasing elements may be $D_{grid}$. The elements of the first array 420 of phasing elements may have "X" shapes or some other shape. X-shaped phasing elements may operate as crossed dipole structures, and may be characterized by dimensions $L_{dipole}$ and $W_{dipole}$.

The second array 430 of phasing elements may be interleaved with the first array 420 of phasing elements such that the elements of the second array 430 are positioned in the interstitial spaces between the elements of the first array 420. The elements of the second array 430 of phasing elements may have square patch shapes, characterized by the dimension $L_{patch}$, or some other shape. The elements of the second array of phasing elements may have diamond, circular, or square patch shape, cross or "X" shape, square or circular annular ring shape, or some other shape.

The dimensions and shape of the elements in the first and second arrays of phasing elements may collectively determine the phase shift induced when microwave radiation is reflected from the reflect array. At least one dimension of the elements in either or both of the first array of phasing elements and the second array of phasing elements may be varied across the reflect array.

Figure 5:
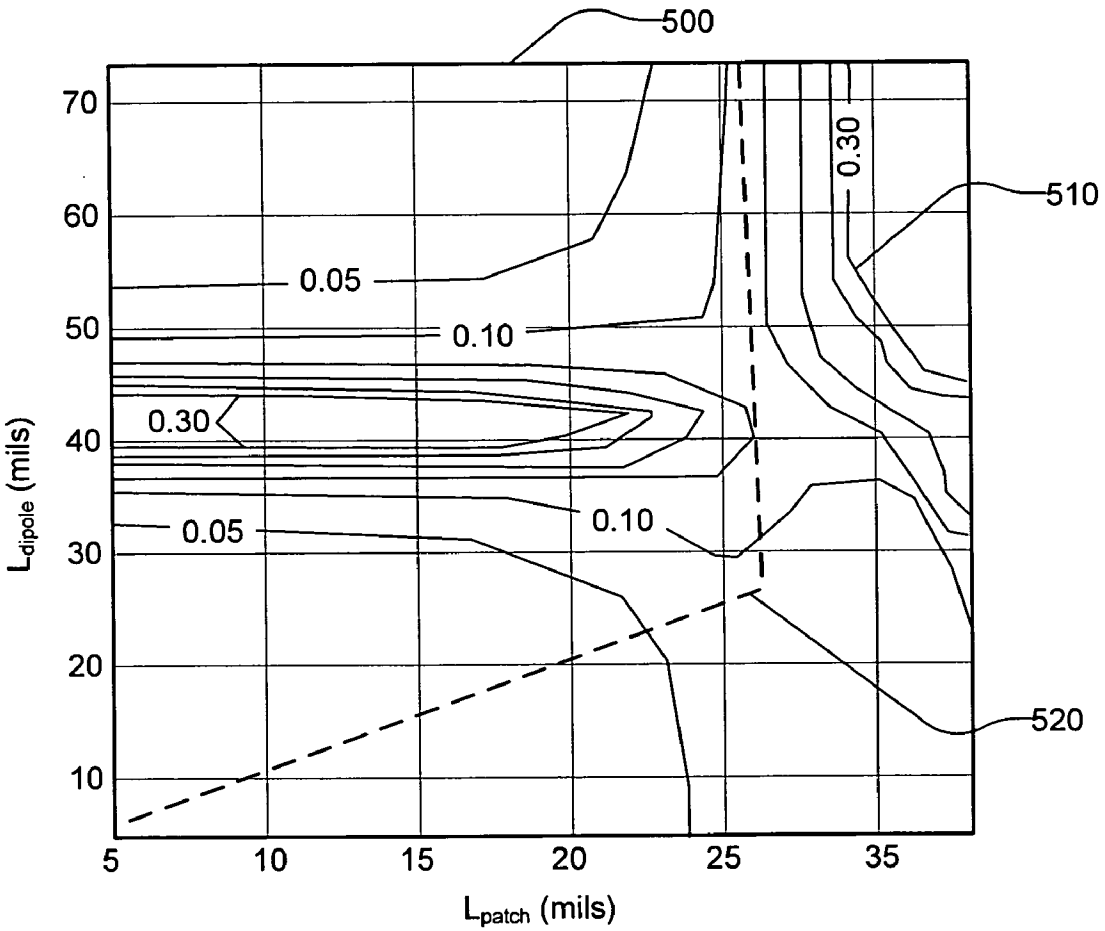
FIG. 5 is a graphical representation of simulation results showing the loss of a low loss variable phase reflect array.

Referring now to FIG. 5, a graph 500 summarizes simulated performance data for a reflect array which may be the reflect array 400. The graph 500 shows the dependence of reflection loss on the dimensions $L_{patch}$ and $L_{dipole}$. The reflection loss, in dB, is shown by a series of contour lines, such as contour line 510, at 0.05 dB increments from 0.05 dB to 0.30 dB. The dashed line 520 shows the locus of combinations of $L_{patch}$ and $L_{dipole}$ that span the range $0.005" \leqq L_{dipole} \leqq 0.072"$ while having a reflection loss less than 0.15 dB.

Figure 6:
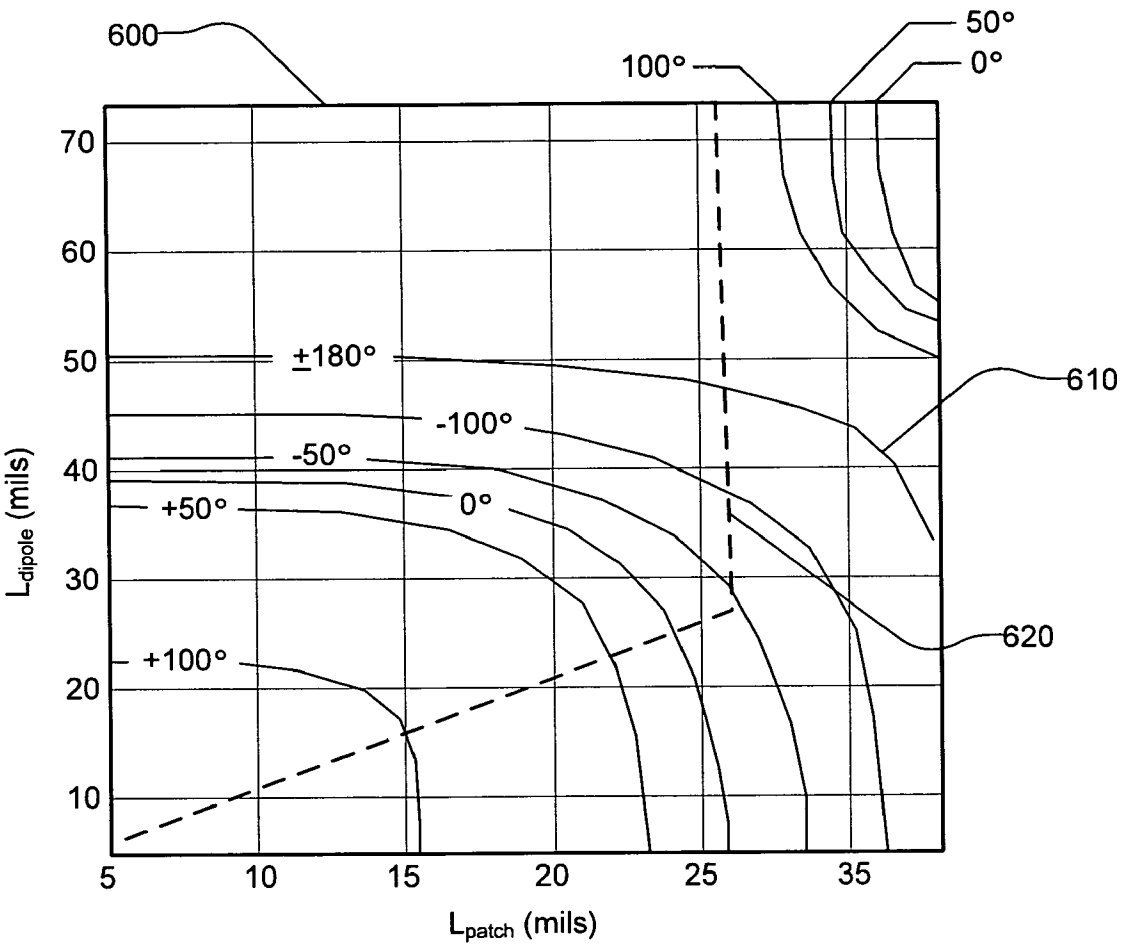
FIG. 6 is a graphical representation of simulation results showing the phase of a low loss variable phase reflect array.

Referring now to FIG. 6, a graph 600 summarizes simulated performance data for a reflect array which may be the reflect array 400. The graph 600 shows the dependence of phase shift on the dimensions $L_{patch}$ and $L_{dipole}$. The phase shift is shown by a series of contour lines, such as contour line 610. The phase shift is indicated for each contour line. The dashed line 620, imported from the graph 500, shows the locus of combinations of $L_{patch}$ and $L_{dipole}$ having a reflection loss less than 0.15 dB. As shown by the curve 310, the phase shift may be varied from about +115 degrees to +120 degrees (after wrapping through ±80 degrees) by varying the dipole length from less than 10 mils (0.010 inches) to more than 70 mils (0.070 inches). Thus combinations of $L_{patch}$ and $L_{dipole}$ along dashed line 620 provide a continuous range of phase shift values spanning nearly 360 degrees.

Figure 7:
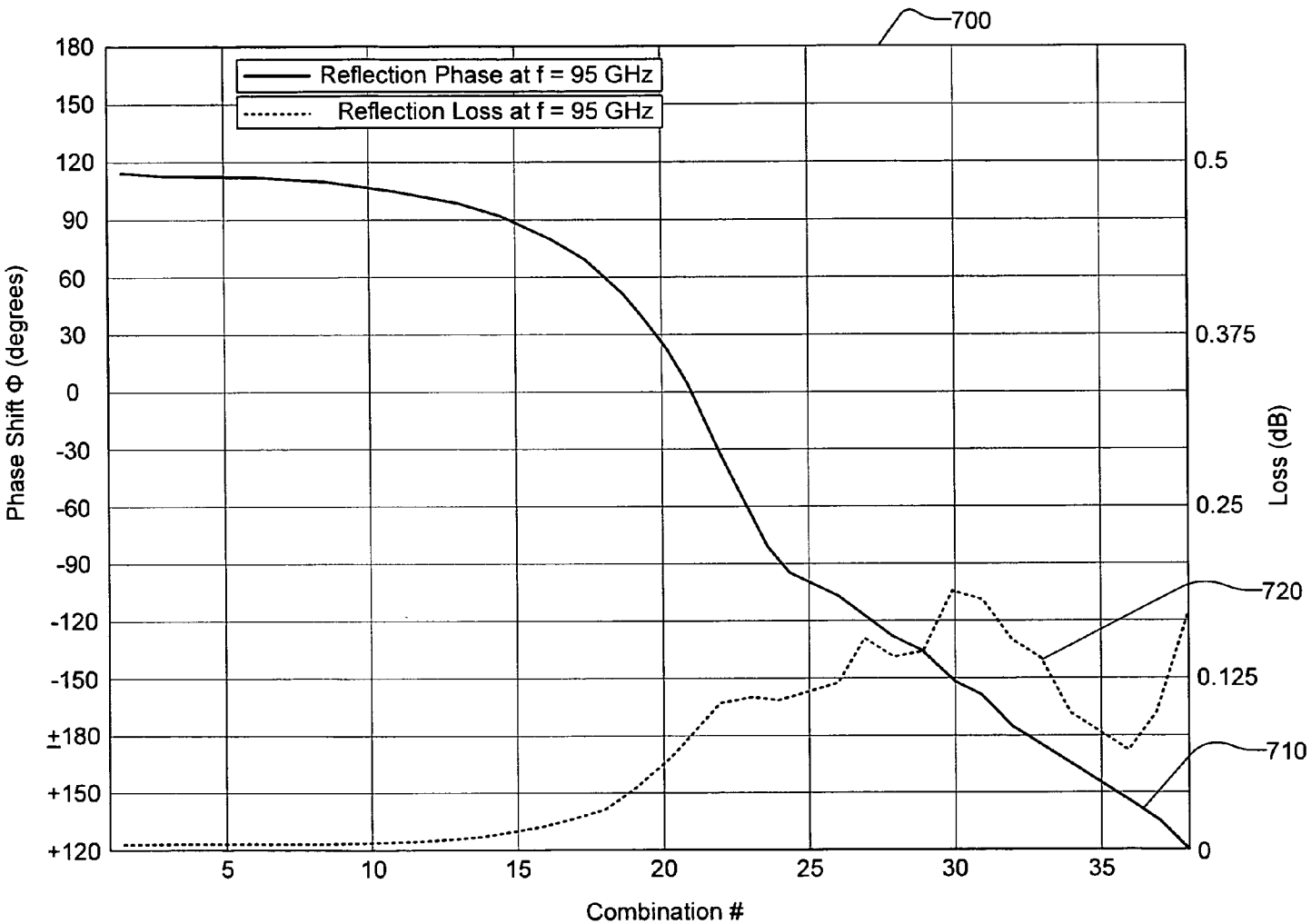
FIG. 7 is a graphical representation of simulation results showing the performance of a variable phase reflect array.

FIG. 7 summarizes the performance of 37 combinations of $L_{patch}$ and $L_{dipole}$ selected at roughly equal distances along the dashed line 520/620 shown in the previous figures. Combination #1 corresponds to a point near the end of the dashed line 520/620 near the lower right corner of graphs 500/600. Combination 37 corresponds to a point near the end of the dashed line near the top of graphs 500/600.

As shown by the curve 710, the simulated combinations of $L_{patch}$ and $L_{dipole}$ provide a range of phase shift of nearly 360 degrees (from about +115 degrees to +120 degrees after wrapping through ±180 degrees). As shown by the curve 720, the simulated combinations of $L_{patch}$ and $L_{dipole}$ have a reflection loss of less than 0.17 dB for any value of reflection phase. Thus a reflect array, such as reflect array 400, having both first and second arrays of phasing elements may provide improved phase-shift range and/or reduced reflection loss compared to the performance of a reflect having a single array of phasing elements, such as reflect array 100. The reflection loss of reflect array, such as reflect array 400, having both first and second arrays of phasing elements may be reduced because a full range of phase shift can be achieved without either the dipole or patch elements being of resonant length.

Figure 8:
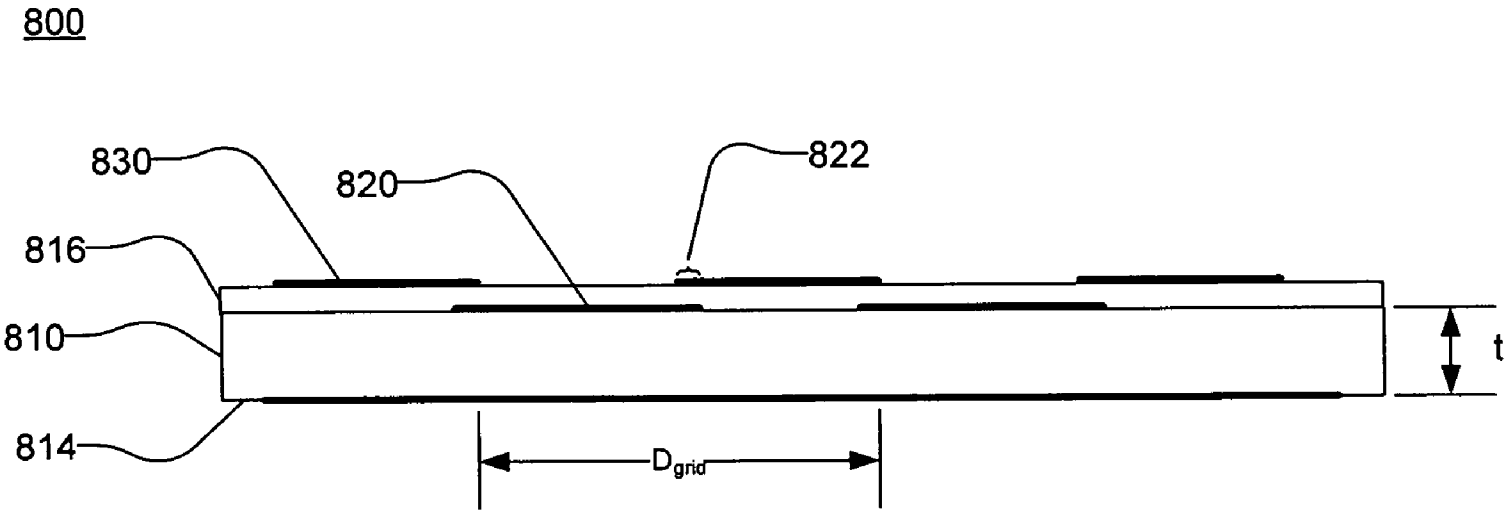
FIG. 8 is a side view of a variable phase reflect array.

A reflect array, such as reflect array 400, may be fabricated with the first array of phasing elements and the second array of phasing elements lying in a single layer supported by a dielectric substrate, as previously shown in FIG. 2. However, additional degrees of freedom, which may be useful to optimize the performance of the reflect array may be available if the first and second arrays of phasing elements are fabricated in different layers, as shown in FIG. 8. A reflect array 800 may include a dielectric substrate 810, which may support a conductive layer on a second surface 814. A first array of phasing elements 820 may be formed in a first conductive layer adjacent to the dielectric substrate 810. A second array of phasing elements 830 may be formed in a second conductive layer separated from the first conductive layer by a dielectric layer 816. The use of two conductive layers separated by a dielectric layer 816 may allow the elements of the first array 820 and the second array 830 to partially overlap, as shown at 822.

Figure 9:
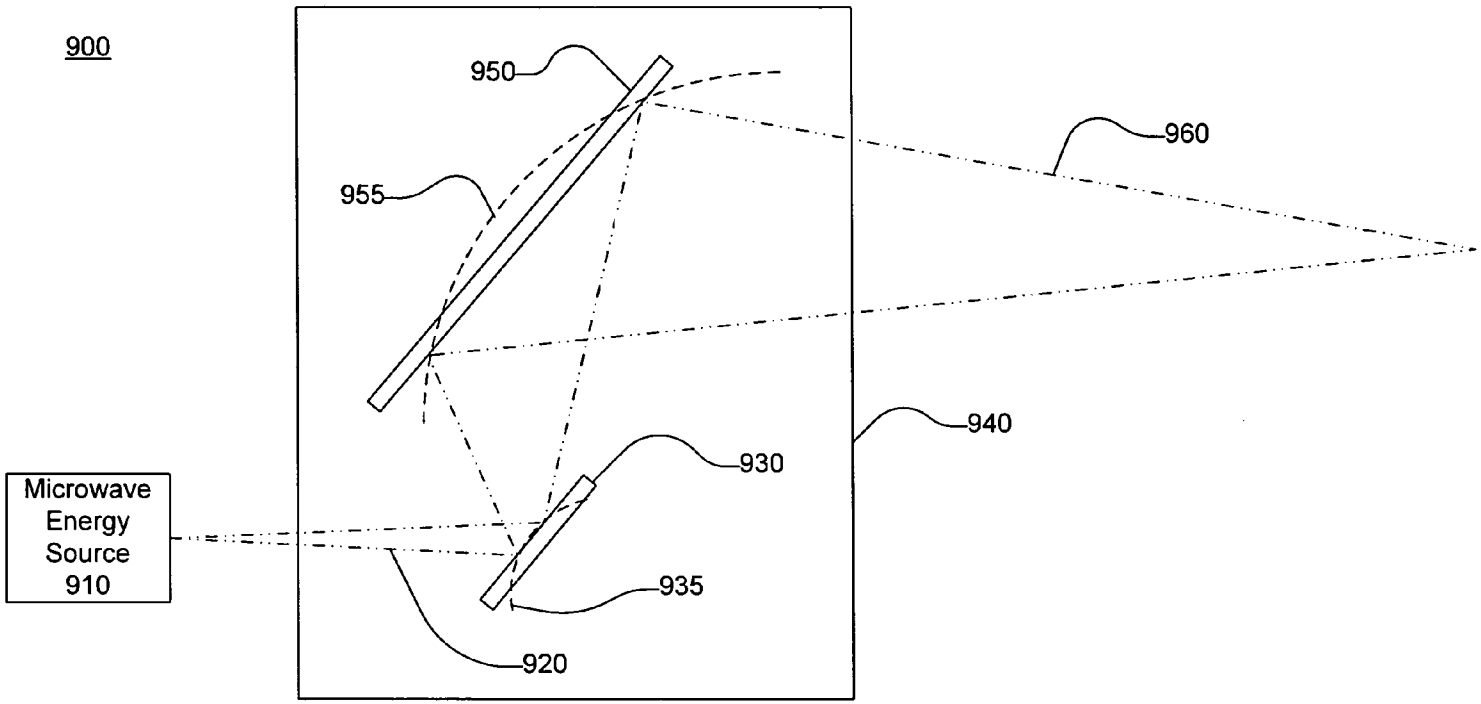
FIG. 9 is a block diagram of a system to generate a beam of microwave energy.

Referring now to FIG. 9, an exemplary system for generating a beam of microwave energy may include a source of microwave energy 910 and a beam director 940. The source of microwave energy 910 may be a solid state source, a vacuum tube source, or another source providing microwave energy. The beam director 940 may include one or more beam forming elements such as a primary reflector 950 and a secondary reflector 930. The beam director 940 may receive microwave energy 920 from the microwave energy source 910 and may form the received microwave energy 920 into a beam of microwave energy 960. The beam of microwave energy 960, shown as a converging beam in FIG. 9, may be a collimated beam, a diverging beam, or a beam having some other wavefront figure.

At least one element of the beam director 940 may be a reflect array such as reflect array 400. In the example of FIG. 9, the primary reflector 950 is shown to be a planar reflect array emulating a concave reflector indicated by dashed line 955. In the example of FIG. 9, the secondary reflector 930 is shown to be a planar reflect array emulating a convex reflector indicated by dashed line 935. At least one of the beam steering elements in beam director 940 may be a reflect array having interleaved first and second arrays of phasing elements.

Description of Processes

Continuing to refer to FIG. 9, a process for providing a beam of microwave energy may include generating microwave energy using a source such as microwave energy source 910, and forming the generated microwave energy into a beam of microwave energy, such as microwave energy beam 960, using a beam director such as beam director 940.

Figure 10:
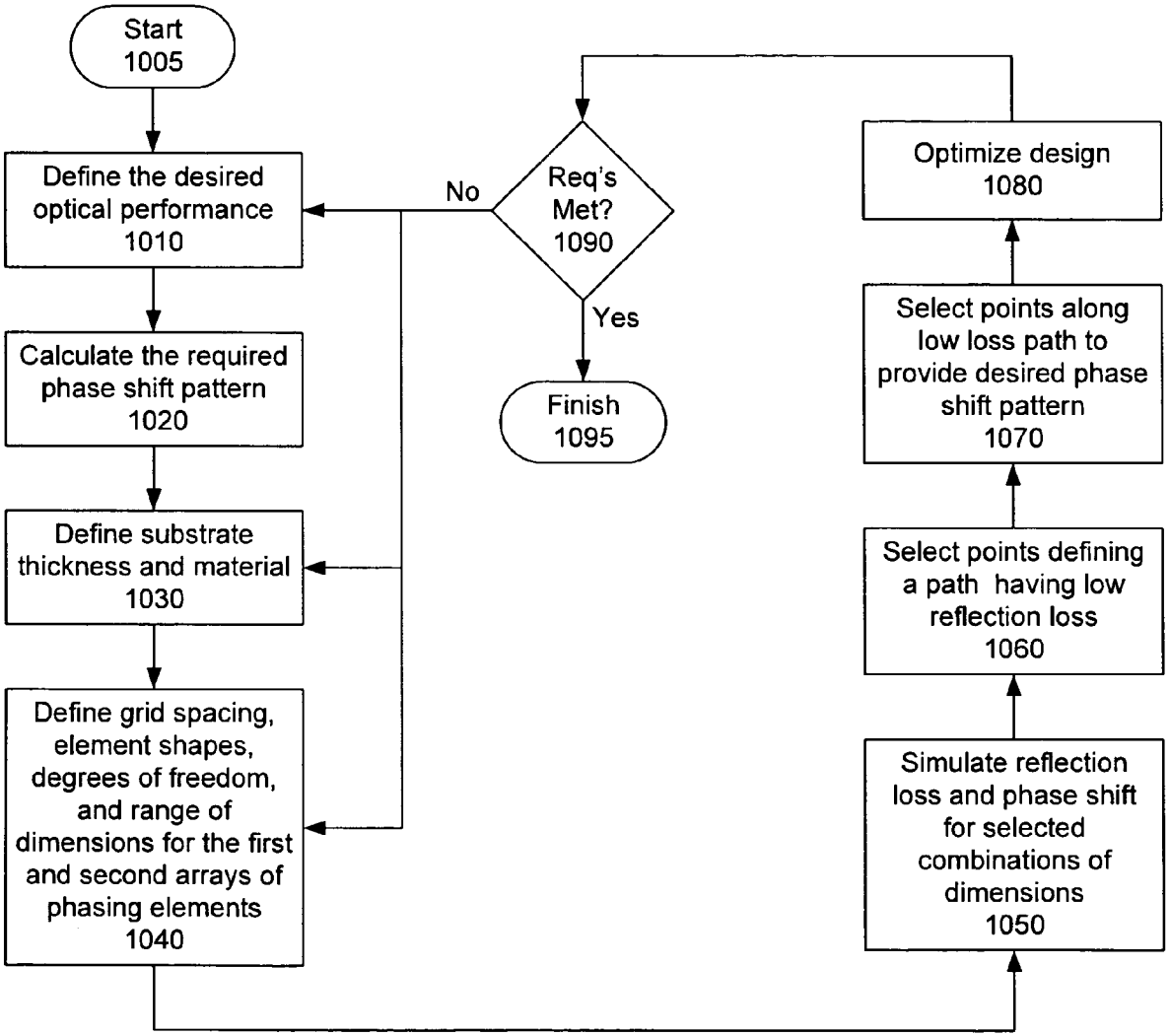
FIG. 10 is a flow chart of a process to design a low loss variable phase reflect array.

Referring now to FIG. 10, a process 1000 for designing a reflect array has both a start 1005 and an end 1095, but the process is cyclical in nature and may be repeated iteratively until a successful design is achieved. At 1010 the desired optical performance desired for the reflect array may be defined. For example, the defined performance may include converting an incident beam having a first wavefront into a reflected beam having a second wavefront, where the second wavefront is not a specular reflection of the first wavefront. The desired performance may also include a definition of an operating wavelength or range of wavelengths, and a maximum reflection loss. The reflect array may commonly be a component in a larger system and the desired performance of the reflect array may be defined in conjunction with the other components of the system.

At 1020, the required phase shift pattern, or phase shift as a function of position on the reflect array, may be calculated from the wavelength and the first and second wavefronts defined at 1010.

At 1030, the substrate material and thickness may be defined. The substrate material and thickness may be defined based upon manufacturing considerations or material availability, or some other basis.

At 1040, the grid spacing, phasing element shape, degrees of freedom (how many dimensions that are allowed to vary during the design process), and range of dimensions for the first and second arrays of phase elements may be defined. These parameters may be defined by assumption, experience, adaptation of prior designs, other methods, and combinations thereof.

At 1050, the reflection phase shift and reflection loss may be calculated by simulating the performance of the reflect array using a suitable simulation tool. For example, assuming that two degrees of freedom were defined at 1040. At 1050, 10 values spanning the full range for each degree of freedom may be selected, and the reflection phase shift and reflection loss may be calculated may be calculated for each of the $10\times10=100$ combinations of values.

At 1060, the calculated results from 1050 may be evaluated and data points defining a "path" or continuum of data points (each data point corresponding to a pair of values for the assumed two degrees of freedom) having low reflection loss may be selected. For example, the data from 1050 may be graphed as shown in FIG. 5, and the low loss path (i.e. the dashed line 520 in FIG. 5) may be determined by observation. The low loss path may also be defined by numerical analysis of the data from 1050.

At 1070, combinations of values along or near the low loss path may be selected to provide the desired phase shift pattern across the reflect array. The combinations of values may be selected from the combinations simulated at 1050 or may be interpolated from combinations simulated at 1050. At 1080, the performance of the entire reflect array may be simulated and the design may be optimized by iteration.

At 1090, the simulated performance of the reflect array from 1080 may be compared to the optical performance requirements defined at 1010. If the design from 1080 meets the performance requirements from 1010, the process 1000 may finish at 1095. If the design from 1080 does not meet the performance requirements from 1010, the process may repeat from steps 1010 (changing the optical performance requirements), from 1030 (changing the substrate selection), or from 1040 (changing the grid spacing, element shapes, degrees of freedom, or range of dimensions) until the optical performance requirements have been satisfied.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A reflect array, comprising:

a dielectric substrate having a first surface and a second surface;

a continuous conductive layer on the second surface; and a first array of phasing elements and a second array of phasing elements interleaved in a single layer on the first surface, the elements of the first array having a first shape and the elements of the second array having a second shape different from the first shape;

wherein the first array and the second array are collectively configured to reflect an incident microwave beam in a predetermined frequency band to provide a reflected beam, the reflected beam having a phase shift relative to the incident beam that is determined, at least in part, by dimensions of the elements of both the first and second arrays of phasing elements; and wherein a spacing between adjacent elements of the second array is substantially equal to a spacing between adjacent elements in the first array.

2. The reflect array of claim 1, wherein the elements of the first array are "X" shapes and the elements of the second array are square patches.

3. The reflect array of claim 1, wherein the phase shift at any point within an extent of the reflect array can be set to any value within a continuous range spanning more than 315 degrees by setting dimensions of the phasing elements in the first and second arrays.

4. The reflect array of claim 3, wherein:

the dielectric substrate has a first curvature, and the phase shift is varied across the reflect array to cause the reflect array to emulate a reflector having a second curvature different from the first curvature.

5. The reflect array of claim 4, wherein:

the dielectric substrate is planar, and the reflect array emulates a non-planar reflector.

6. The reflect array of claim 5, wherein the reflect array emulates a curved reflector selected from the group consisting of a parabolic reflector, a spherical reflector, a cylindrical reflector, a torroidal reflector, a conic reflector, and a generalized aspheric reflector.

7. The reflect array of claim 3, wherein the phase shift at any point within the extent of the reflect array can be set to any value within a continuous range spanning more than 355 degrees by setting the dimensions of the phasing elements in the first and second arrays.

8. The reflect array of claim 1, wherein:

the elements of the first array are disposed on a rectangular grid, and the elements of the second array are disposed in interstitial spaces between the elements of the first array.

9. The reflect array of claim 8, wherein:

a spacing between adjacent rows and columns of the rectangular grid is less than a wavelength of microwave radiation in the incident microwave beam.

10. The reflect array of claim 9, wherein:

the spacing between adjacent rows and columns of the rectangular grid is about one-half of the wavelength of the microwave radiation.

11. The reflect array of claim 8, wherein:

the elements of the second array are disposed in the interstitial spaces along the rows and columns of the rectangular grid.

12. The reflect array of claim 1, wherein:

for each pair of adjacent phasing elements in the first array, a single one of the phasing elements in the second array is located between those adjacent phasing elements in the first array.

13. The reflect array of claim 12, wherein, for each phasing element in the second array that is located between adjacent phasing elements in the first array:

a first portion of that phasing element in the second array lies between portions of one neighboring phasing element in the first array; and a second portion of that phasing element in the second array lies between portions of another neighboring phasing element in the first array.

14. A system comprising:

a microwave energy source configured to generate microwave energy in a predetermined frequency band; and a beam director configured to direct the microwave energy received from the microwave energy source, the beam director including a reflect array, the reflect array comprising:

a dielectric substrate having a first surface and a second surface;

a continuous conductive layer on the second surface; and a first array of phasing elements and a second array of phasing elements interleaved in a single layer on the first surface, the elements of the first array having a first shape and the elements of the second array having a second shape different from the first shape;

wherein the first array and the second array are collectively configured to reflect the microwave energy in the predetermined frequency band to provide a reflected beam, the reflected beam having a phase shift relative to the received microwave energy determined, at least in part, by dimensions of the elements of both the first and second arrays of phasing elements; and wherein a spacing between adjacent elements of the second array is substantially equal to a spacing between adjacent elements in the first array.

15. The system of claim 14, wherein the phase shift at any point within an extent of the reflect array can be set to any value within a continuous range spanning more than 315 degrees by setting dimensions of the phasing elements in the first and second arrays.

16. The system of claim 15, wherein the phase shift at any point within the extent of the reflect array can be set to any value within a continuous range spanning more than 355 degrees by setting the dimensions of the phasing elements in the first and second arrays.

17. The system of claim 14, wherein:

for each pair of adjacent phasing elements in the first array, a single one of the phasing elements in the second array is located between those adjacent phasing elements in the first array; and for each phasing element in the second array that is located between adjacent phasing elements in the first array:

a first portion of that phasing element in the second array lies between portions of one neighboring phasing element in the first array; and a second portion of that phasing element in the second array lies between portions of another neighboring phasing element in the first array.

18. A method comprising:

receiving microwave energy in a predetermined frequency band; and forming the microwave energy into a reflected beam with a beam director, the beam director including a reflect array, the reflect array comprising:

a dielectric substrate having a first surface and a second surface;

a continuous conductive layer on the second surface; and a first array of phasing elements and a second array of phasing elements interleaved in a single layer on the first surface, the elements of the first array having a first shape and the elements of the second array having a second shape different from the first shape;

wherein the first array and the second array are collectively configured to reflect the microwave energy in the predetermined frequency band to provide the reflected beam, the reflected beam having a phase shift relative to the received microwave energy determined, at least in part, by dimensions of the elements of both the first and second arrays of phasing elements; and wherein a spacing between adjacent elements of the second array is substantially equal to a spacing between adjacent elements in the first array.

19. The method of claim 18, wherein the phase shift at any point within an extent of the reflect array can be set to any value within a continuous range spanning more than 315 degrees by setting dimensions of the phasing elements in the first and second arrays.

20. The method of claim 19, wherein the phase shift at any point within the extent of the reflect array can be set to any value within a continuous range spanning more than 355 degrees by setting the dimensions of the phasing elements in the first and second arrays.

* * * * *